US005151567A

United States Patent [19]

Thuries

[11] Patent Number: 5,151,567

[45] Date of Patent: Sep. 29, 1992

[54] CIRCUIT BREAKER CONTROL APPARATUS

[75] Inventor: Edmond Thuries, Meyzieu, France

[73] Assignee: GEC Alsthom SA, Paris, France

[21] Appl. No.: 757,373

[22] Filed: Sep. 10, 1991

[30] Foreign Application Priority Data

Sep. 10, 1990 [FR] France ..... 90 11179

[51] Int. Cl.[5] ..... H01H 33/42; H01H 5/00; H01H 3/00

[52] U.S. Cl. ..... 200/148 F; 200/400; 200/145; 335/76

[58] Field of Search ..... 200/145, 148 F, 144 R, 200/148 B, 400; 335/76

[56] References Cited

FOREIGN PATENT DOCUMENTS 0221430 5/1987 European Pat. Off. .
0372449 6/1990 European Pat. Off. .
966573 8/1957 Fed. Rep. of Germany .

*Primary Examiner*—Harold Broome
*Attorney, Agent, or Firm*—Sughrue, Mion, Zinn, Macpeak & Seas

[57] ABSTRACT

Circuit breaker control apparatus uses a DC motor and has only one spring for disengagement purposes.

1 Claim, 2 Drawing Sheets

CIRCUIT BREAKER CONTROL APPARATUS

The present invention relates to controlling a circuit breaker, in particular a medium tension or a high tension circuit breaker, and it serves to perform standardized opening and closing cycles.

BACKGROUND OF THE INVENTION

A circuit breaker control apparatus is described, in particular, in Document EP-A1-0221430 enabling a rapid open, close, and open again cycle (OCO cycle) to be performed, the apparatus including two springs organized so that relaxing one of the springs enables the circuit breaker to be operated once while simultaneously also storing energy in the other spring. Control apparatuses of this type comprise a large number of mechanical parts and they are expensive to assemble and to maintain.

The prior art is also illustrated by Document DE-C-966573 which describes a compressed air control apparatus having only one spring and including an electromagnet that controls a pilot to operate the power piston, and by Document EP-A-0372449 which describes high power control apparatus including two springs actuated by a motor, with the assembly being driven by a low power control apparatus.

An object of the present invention is to provide an electromechanical type of circuit breaker control apparatus that includes a small number of mechanical parts and that is consequently relatively cheap to purchase and to maintain.

SUMMARY OF THE INVENTION

The present invention provides a control apparatus for a medium tension or a high tension circuit breaker having a plurality of poles each provided with a drive rod, the control apparatus comprising a DC motor provided with a shaft controlling the motion of the drive rods of said poles, said shaft being fixed to an arm having a first end fixed to a first end of a disengagement spring whose opposite end is fixed to a fixed point, said arm being capable of taking up a first position in which the spring stores energy and the poles of the circuit breaker are engaged, and a second position in which the spring is relaxed and the poles are disengaged, the second end of the arm being provided with a displaceable abutment capable of taking up a first position in which it holds the arm in said first position and a second position in which it releases the arm, the motor being powered by a battery, the abutment being displaceable by means of an electromagnetic actuator, and the power supply to the motor and to the actuator being under the control of a programmed electronic circuit to perform a given cycle.

BRIEF DESCRIPTION OF THE DRAWINGS

An embodiment of the invention is described by way of example with reference to the accompanying drawings, in which.

DETAILED DESCRIPTION

Figure 1:
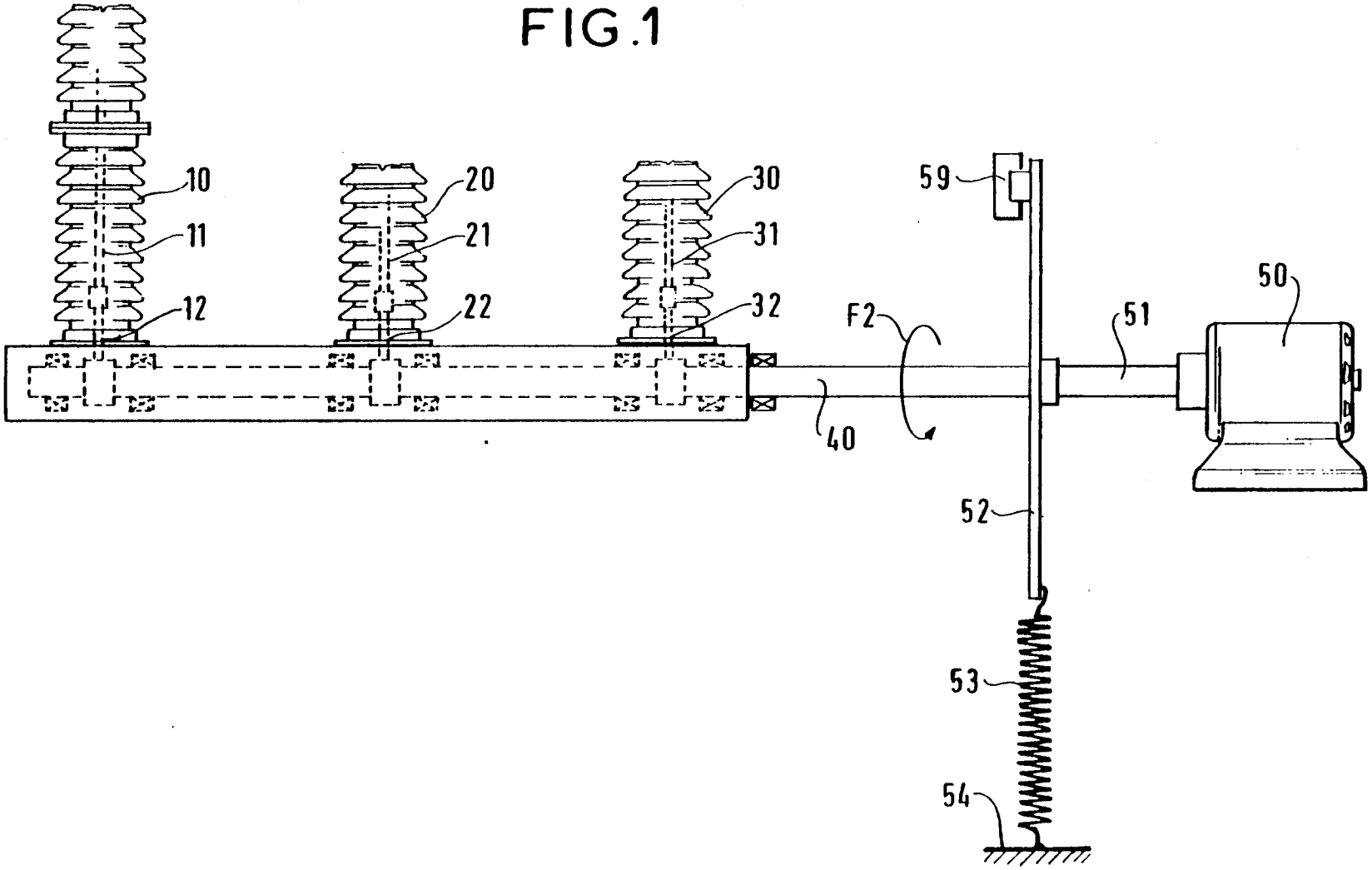
FIG. 1 is a fragmentary elevation view of a three-pole circuit breaker provided with control apparatus of the invention.
Figure 2:
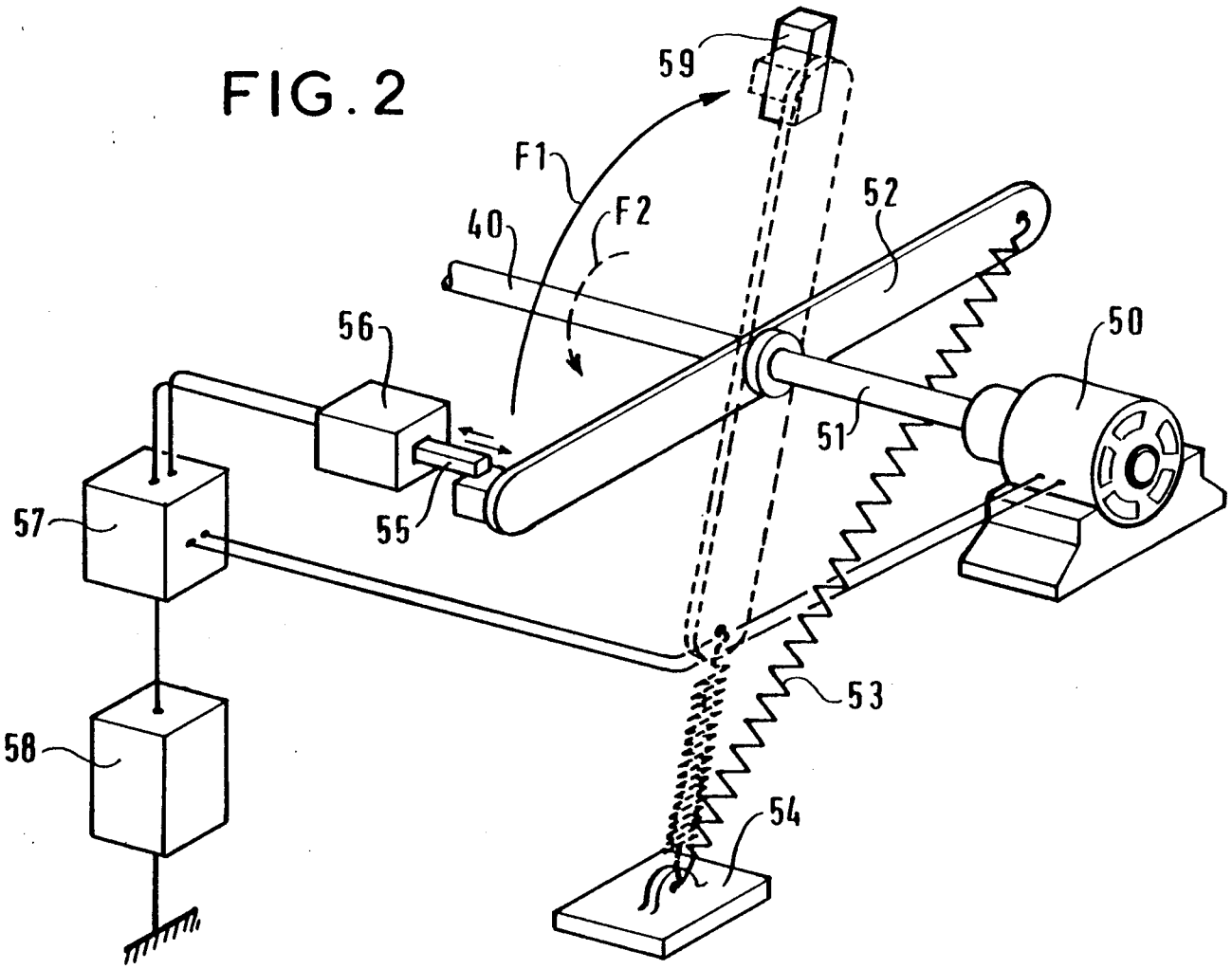
FIG. 2 is a diagrammatic perspective view of the above-mentioned control apparatus.

In FIG. 1, references 10, 20, and 30 designate respective ceramic insulating columns supporting the circuit-breaking chambers of a three-pole circuit breaker. These chambers are driven by rods given respective references 11, 21, and 31, which rods are connected to a common drive shaft 40 by connecting rods 12, 22, and 32. The shaft 40 is put into motion by the control apparatus of the invention, which apparatus is visible in greater detail in FIG. 2.

The control apparatus of the invention comprises a DC motor 50 whose shaft 51 is in alignment with the above-mentioned shaft 40 and is fixed thereto. The shaft 51 has an arm 52 fixed thereon, with one end of the arm being fixed to a first end of a spring 53 and with the other end of the spring being attached to a fixed point 54.

The arm can take up a first position in which the spring 53 stores energy, corresponding to the circuit breaker being in an engaged position. The arm is held in this first position by a retractable abutment 55, e.g. by means of an electromagnet 56 under the control of a programmed electronic circuit 57. The electronic circuit is powered by an electrical storage battery 58. This battery also powers the DC motor 50 via the electronic circuit 57.

When the circuit breaker is to be disengaged, an instruction coming from a relay (not shown) is delivered to the electronic circuit 57 which then powers the electromagnet 56, thereby retracting the abutment 55. The spring then releases suddenly causing the arm to pivot in the direction of solid line arrow F1, thereby rotating the shafts 51 and 40 and opening the poles of the circuit breaker. The stroke of the arm is stopped by a fixed abutment 59 acting as a shock absorber.

When the circuit breaker is to be closed, the electronic circuit feeds power to the motor 50 which rotates the shaft 51 and the arm 53 in the direction of dashed-line arrow F2. This operation stores energy again in the spring 53 and also recloses the circuit breaker. A DC motor, e.g. a series excitation motor, provides a high level of starting torque, thereby making it possible to store energy in the spring and reclose the circuit breaker within a period of time that is compatible with that laid down for standardized OCO cycles. The electronic circuit is programmed to power the electric motor for just sufficient time to enable the circuit breaker to be reclosed and to enable the spring to be re-loaded, and to slow down the end-of-stroke motion of the apparatus. If a second circuit breaker opening operation is requested, then it takes place like the first.

Implementing the invention requires a 24 volt or a 48 volt storage battery to be used having a capacity that the person skilled in the art can calculate as a function of the type of circuit breaker to be controlled and as a function of the kind of cycles to be performed.

The control apparatus of the invention has a small number of mechanical parts and consequently its cost price is moderate and its maintenance cost is low.

I claim:

1. Control apparatus for a medium tension or a high tension circuit breaker having a plurality of poles each provided with a drive rod, said control apparatus comprising a DC motor provided with a shaft controlling the motion of the drive rods of said poles, said shaft being fixed to an arm having a first end and a second end, said first end being fixed to a first end of a disengagement spring and said second end being fixed to a fixed point, said arm being capable of taking up a first position in which the spring stores energy and the poles of the circuit breaker are engaged, and a second position in which the spring is relaxed and the poles are disengaged, said second end of the arm being engagable with a retractable abutment capable of taking up a first position in which said abutment holds the arm in said first position and a second position in which said abutment releases the arm, said motor being powered by a power supply, the abutment being retractable by means of an electromagnetic actuator powered by said power supply, and said power supply to the motor and to the actuator being under the control of a programmed electronic circuit to perform a given cycle.

* * * * *